US005785421A

United States Patent [19]

Milek

[11] Patent Number: 5,785,421

[45] Date of Patent: Jul. 28, 1998

[54] MOBILE MODULAR CONCRETE BATCH PLANT

[76] Inventor: Robert C. Milek, 6560 Stones Throw Dr., Omaha, Nebr. 68152

[21] Appl. No.: 734,876

[22] Filed: Oct. 22, 1996

[51] Int. Cl.[6] ..... B28C 7/04

[52] U.S. Cl. ..... 366/33; 366/41; 366/16; 414/212

[58] Field of Search ..... 366/33, 30, 42, 366/49, 41, 16, 14, 18, 19, 20, 181.1, 181.2, 181.3, 183.1; 414/212, 172, 196

[56] References Cited

U.S. PATENT DOCUMENTS

| | | | |
|---|---|---|---|
| 3,746,313 | 7/1973 | Weeks et al. | 366/19 |
| 3,820,762 | 6/1974 | Bostrom et al. | 366/18 |
| 3,938,673 | 2/1976 | Perry, Jr. | 366/18 |
| 3,998,436 | 12/1976 | Allen et al. | 366/18 |
| 4,204,773 | 5/1980 | Bates | 366/18 |
| 4,339,204 | 7/1982 | Placzek | 366/18 |
| 4,427,297 | 1/1984 | Stastny | 366/33 |
| 4,580,902 | 4/1986 | Dunstan | 366/49 |
| 4,775,275 | 10/1988 | Perry | 366/18 |
| 4,792,234 | 12/1988 | Doherty | 366/18 |
| 4,956,821 | 9/1990 | Fenelon | 366/16 |
| 4,997,284 | 3/1991 | Tousignant et al. | 366/14 |
| 5,171,121 | 12/1992 | Smith et al. | 366/33 |
| 5,667,298 | 9/1997 | Musil et al. | 366/33 |

*Primary Examiner*—Tony G. Soohoo
*Attorney, Agent, or Firm*—Zarley,McKee,Thomte Voorhees & Sease; Mark D. Frederiksen

[57] ABSTRACT

A batching module for a mobile batching plant includes an open three dimensional frame with first and second end cells defined therein and a third intermediate cell defined between the end cells. A plurality of interchangeable batching apparatus are provided for removable installation within the cells. A reversible conveyor is mounted within the frame and extends between the ends thereof to convey materials deposited thereon from the batching apparatus to either the first or second end of the frame. Length extensible support legs are mounted to the batching apparatus frame to permit selective height adjustment of the frame above the ground. The legs are telescopically mounted within vertical hollow support posts of the frame for selective retraction completely within the frame posts. Either mobile mixers or stationary mixers may be positioned under the first and second cells to receive product from the batchers and conveyor.

16 Claims, 5 Drawing Sheets

MOBILE MODULAR CONCRETE BATCH PLANT

TECHNICAL FIELD

The present invention relates generally to batch plants for the proportional mixing of ingredients for concrete, and more particularly to an improved mobile modular concrete batch plant with adjustable, transportable and interchangeable components.

BACKGROUND OF THE INVENTION

Historically, concrete is created by mixing materials stored in overhead bins which are delivered by gravity to hopper scales beneath the bins, and then in proportioned amounts from the hopper scales to mixers beneath the scales. The mixers are either truck mounted, for transport to a remote site, or stationary. The main problem with such vertically disposed systems is in the considerable height required to feed, batch, and mix the concrete. This in turn requires extremely long conveyors to reach the overhead bins to provide the supply of components for the concrete.

Mobile batch plants are provided for job sites remote from the main plant, which require large amounts of concrete. Typical mobile batch plants utilize aggregate bins which are positioned low to the ground. However, these systems require that the batched aggregate be conveyed upwardly on an inclined conveyor to reach the mixer. If large stationary mixers are utilized at the remote job site, then the mobile batch plant must be raised above the ground to an additional height to receive the mixer thereunder. Such adjustment in the height of the batch plant is not easily accomplished since the support structure for the batch plant is typically a relatively permanent frame work.

In addition, mobile batch plants suffer from the effects of wind and weather, since they are not easily enclosed for winter operations. Nor do mobile batch plants permit simple modification for use of different supply components. Thus, if a slurry batcher is needed at a job site in addition to a conventional cement and fly ash batcher, it is typically necessary to construct a separate framework for this special case.

SUMMARY OF THE INVENTION

It is therefore a general object of the present invention to provide an improved mobile modular concrete batch plant.

Another object is to provide a mobile batch plant with transportable modular components which may be interchangeably connected in various arrangements.

Yet another object of the present invention is to provide a mobile modular batch plant with a batching module which is easily vertically adjustable for various types of mixers.

Still a further object is to provide a mobile modular batch plant which is capable of two separate batching operations.

A further object of the present invention is to provide a mobile modular batch plant which may be easily enclosed against wind and weather.

These and other objects of the present invention will be apparent to those skilled in the art.

The batching module for a mobile batching plant of the present invention includes an open three dimensional frame with first and second end cells defined therein and a third intermediate cell defined between the end cells. A plurality of interchangeable batching apparatus are provided for removable installation within the cells. A reversible conveyor is mounted within the frame and extends between the ends thereof to convey materials deposited thereon from the batching apparatus to either the first or second end of the frame. Length extensible support legs are mounted to the batching apparatus frame to permit selective height adjustment of the frame above the ground. The legs are telescopically mounted within vertical hollow support posts of the frame for selective retraction completely within the frame posts. Either mobile mixers or stationary mixers may be positioned under the first and second cells to receive product from the batchers and conveyor.

DESCRIPTION OF THE PREFERRED EMBODIMENTS

Figure 1:
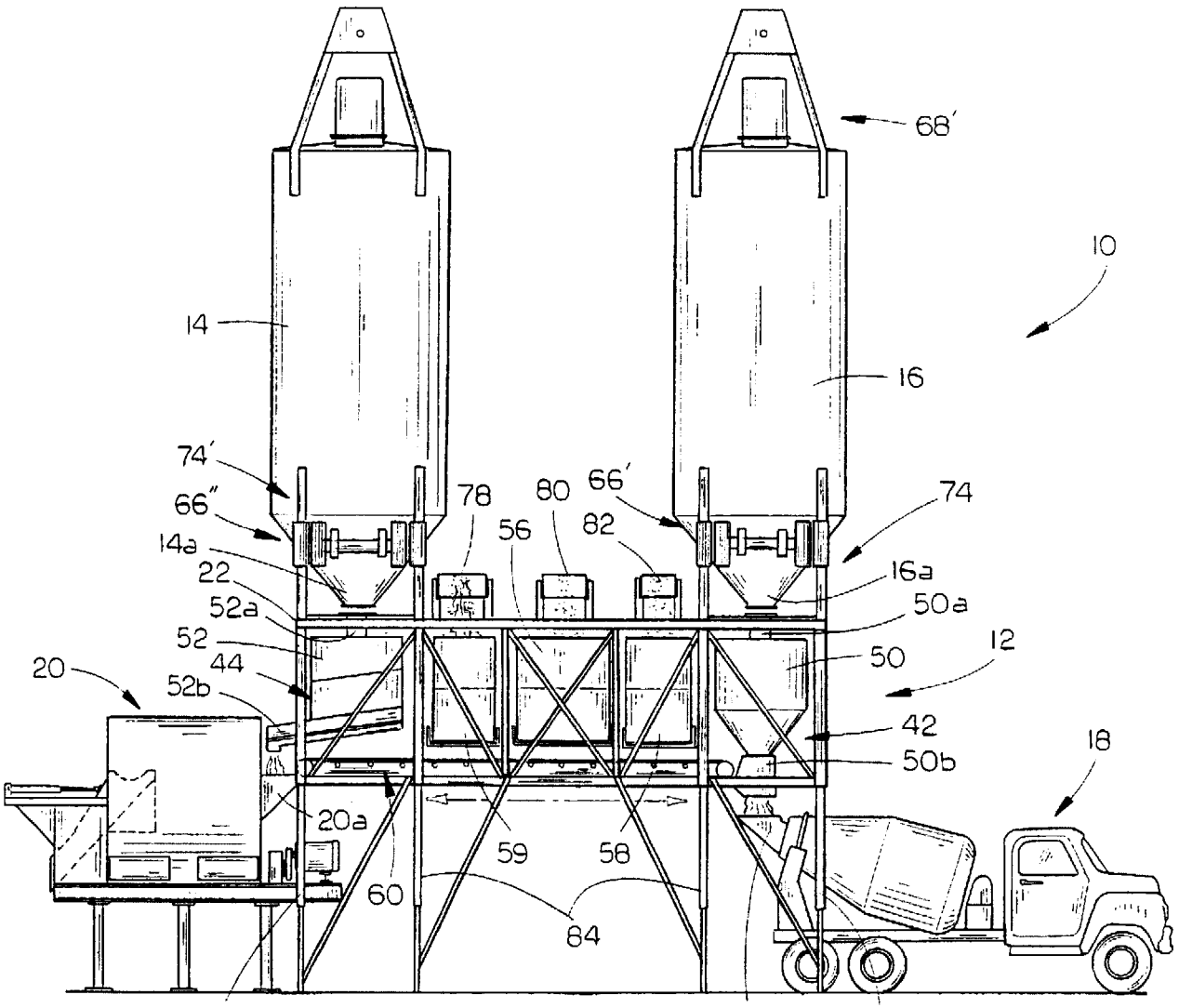
FIG. 1 is a side elevational view of the mobile modular concrete batch plant of the present invention.

Referring now to the drawings, in which similar or corresponding parts are identified with the same reference numeral and more particularly to FIG. 1, the mobile modular concrete batch plant of the present invention is designated generally at 10 and includes a batching module 12 operationally interconnected with a pair of overhead supply silos 14 and 16, a mobile mixer 18, and a stationary drum mixer 20.

Figure 2:
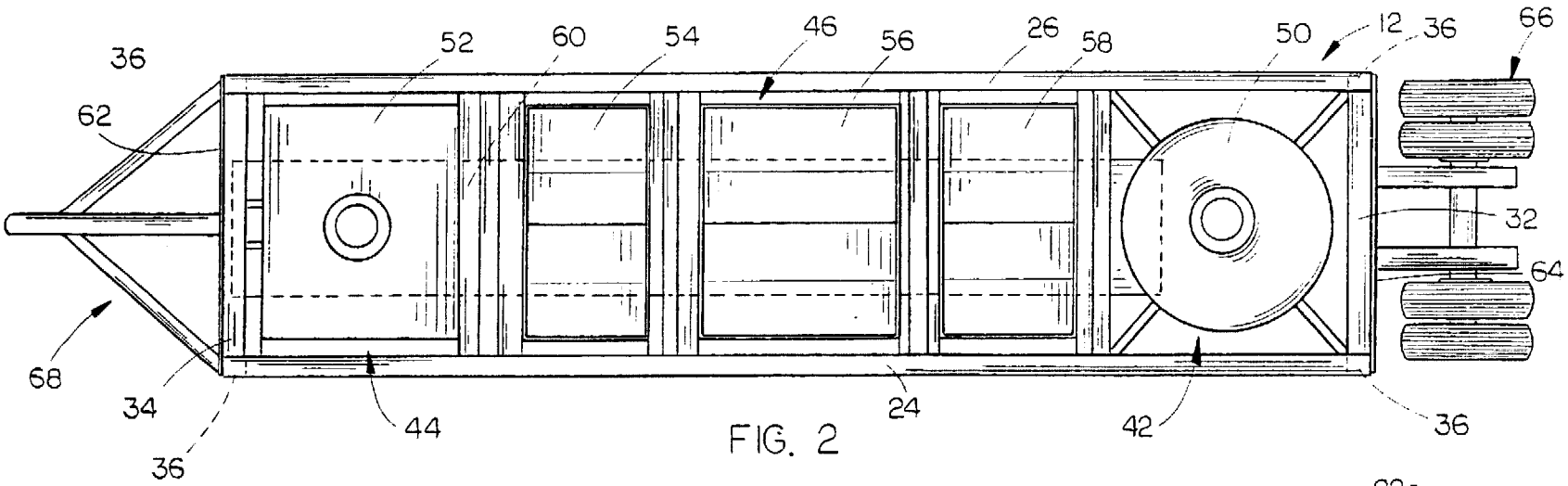
FIG. 2 is a top view of the batching module of the present invention.
Figure 3:
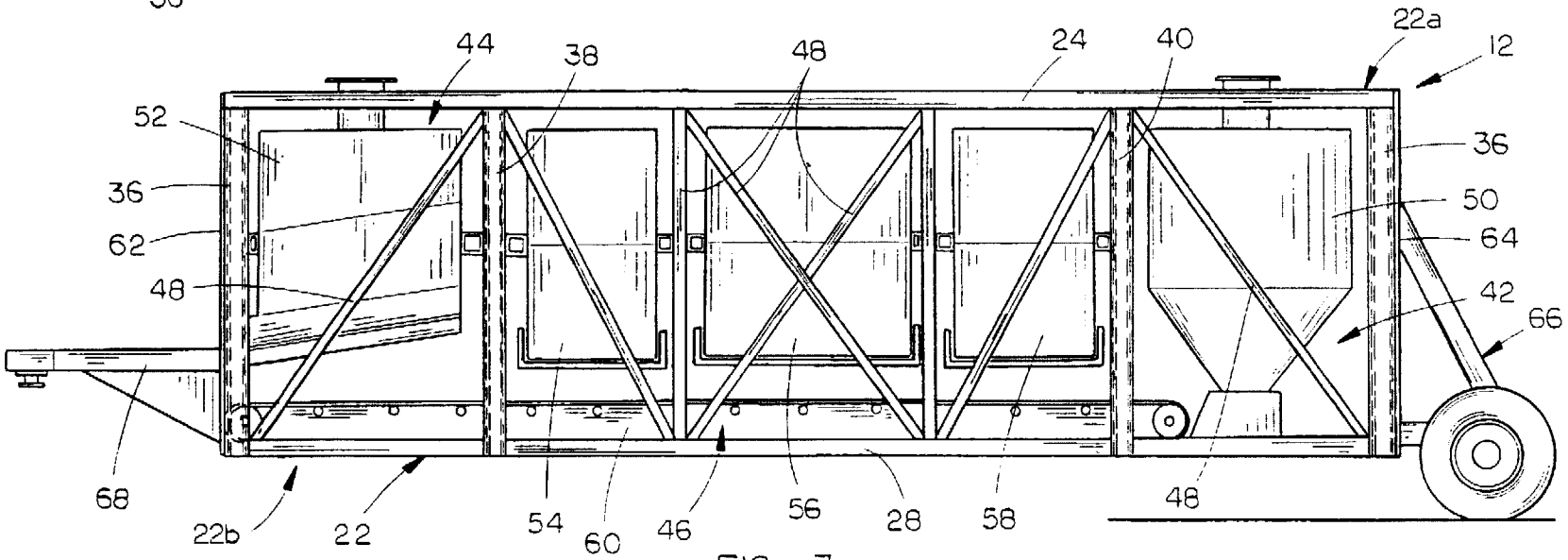
FIG. 3 is a side elevational view of the batching module.

Referring now to FIGS. 2 and 3, batching module 12 includes an open frame 22 having a pair of spaced apart forward and rearward upper beams 24 and 26, forward and rearward lower beams 28 and 30 (rearward lower beam 30 not shown), an upper cross-member 32 connected between the first ends of beams 24 and 26, and an upper cross-member 34 connected between the second ends of beams 24 and 26. A pair of lower cross-members (not shown) connect the first ends of lower beams 28 and 30, and the second ends of lower beams 28 and 30, in a similar fashion. Four hollow corner posts 36 are mounted between the ends of the upper and lower beams to form the three dimensional frame 22 of batching module 12. A pair of hollow forward intermediate posts 38 and 40 extend between forward upper and lower beams 24 and 28, and a pair of rearward hollow intermediate posts (not shown) extend between the rearward upper and lower beams in corresponding positions. Intermediate posts 38 and 40 serve to divide batching module 12 into three, three dimensional cells 42, 44 and 46, the first cell 42 located at the first end **22*a* of frame 22, the second cell 44 located at the opposite second end 22*b* of frame 22, and third cell 46 located between intermediate posts 38 and 40, and between cells 42 and 44. Cross-braces 48 are mounted between forward upper and lower beams 24 and 28, and rearward upper and lower beams 26 and 30, to increase the structural integrity of frame 22 and cells 42, 44 and 46**.

Batching module 12 is constructed with an open frame 22 to permit the selective and interchangeable installation of various types of batching apparatus. FIGS. 1, 2 and 3 show a slurry batcher 50 mounted in first cell 42, a cement and fly ash batcher 52 mounted in second cell 44, and three individual aggregate batchers 54, 56 and 58 installed side by side within third cell 46. Each of batchers 50, 52, 54, 56 and 58 are of conventional construction and hopper type scales permitting high speed simultaneous weighing of components within the batchers.

A belt type conveyor 60 is mounted in the lower end of frame 22 and extends longitudinally through frame 22 with a first end disposed within first cell 42 and a second end disposed within second cell 44. Conveyor 60 is oriented under aggregate batchers 54, 56 and 58, and is reversible to carry aggregate to a mixer located adjacent first cell 42, or a mixer located adjacent second cell 44.

Figure 4:
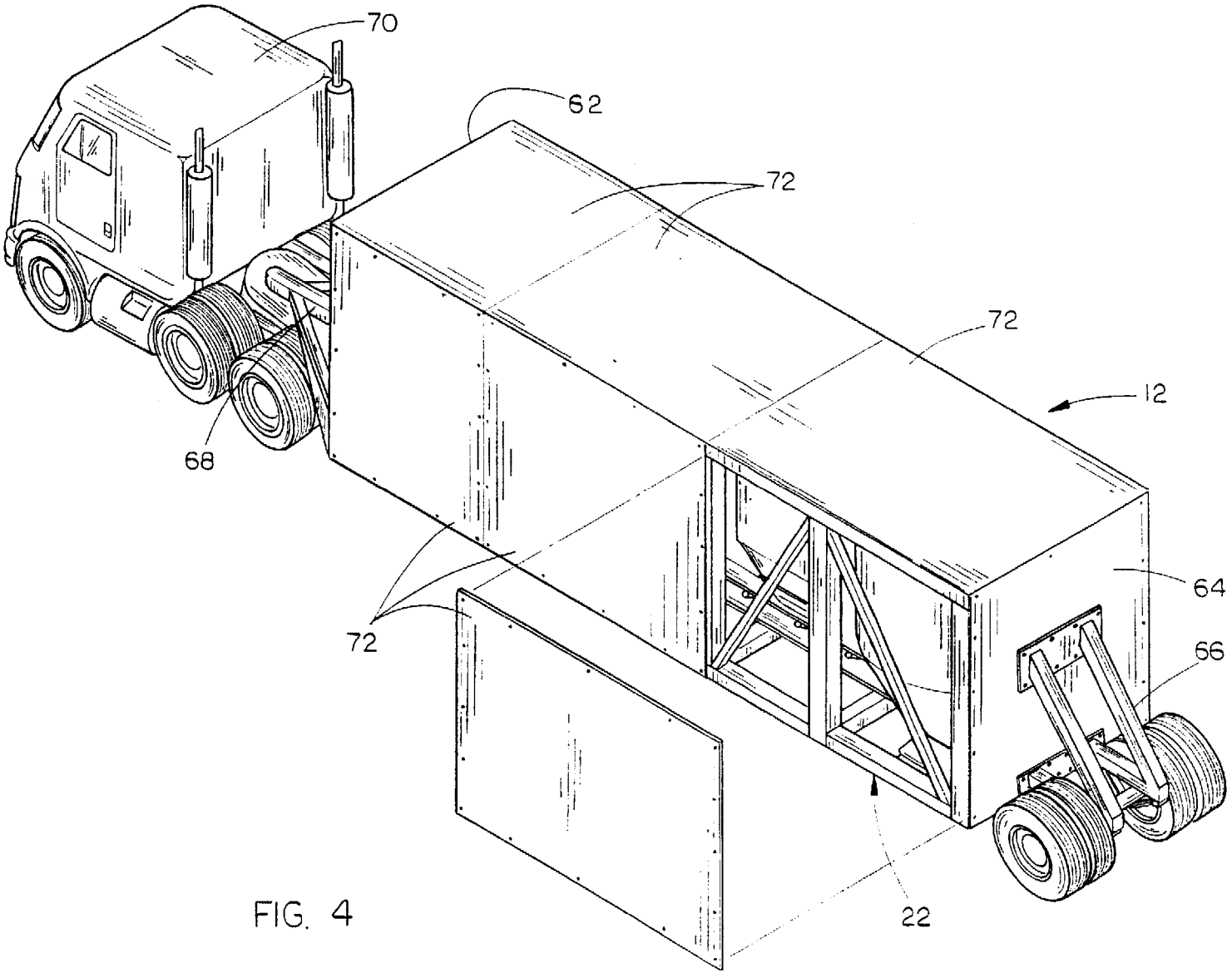
FIG. 4 is a perspective view of the batching module outfitted for transport, and with cover panels attached thereto.

Referring now to FIGS. 2, 3 and 4, batching module 12 is provided with a removable front panel 62 and rear panel 64 on the ends of frame 22. A wheel set 66 is removably mounted to rear panel 64 to permit batching module 12 to be transported. A hitch frame 68 is mounted to front panel 62 for attachment to a tractor 70, for transportation of batching module 12. A plurality of cover panels 72 are connected to frame 22 to enclose batching module 12 during transport. In addition, selective panels 72 may be mounted to the batching module frame 22 for enclosed operation during winter or other weather conditions.

Referring once again to FIG. 1, a wheel set 66' includes a support frame 74 which is mounted to frame 22 directly above first cell 42 to support silo 16 directly above slurry batcher 50. As shown in FIG. 1, silo 16 includes a funnel-shaped outlet end **16*a* positioned directly over an inlet port 50*a* of slurry batcher 50. A hitch frame 68' is also mounted to the ends of silo 16, such that the silo may be transported by a tractor, in a fashion similar to batching module 12**.

A wheel set 66" has a frame 74' which is mounted on batching module frame 22 over the second cell 44 to support supply silo 14 therein, in the same fashion as the first support frame 74. Supply silo 14 includes a funnel-shaped outlet end **14*a* disposed directly over the inlet port 52*a* of cement and fly ash batcher 52**.

Figure 5:
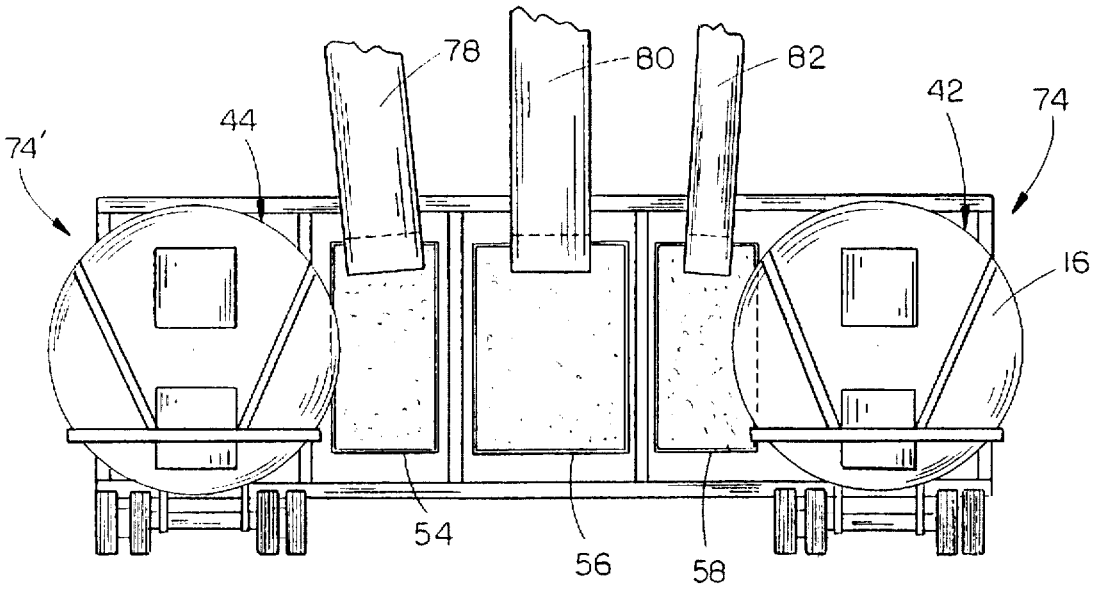
FIG. 5 is a top view of the batching module with storage silos and aggregate conveyors thereto.

Conveyors 78, 80 and 82 have an upper dispensing end located over aggregate batchers 54, 56 and 58 respectively, as shown in FIGS. 1 and 5. Conveyors 78, 80 and 82 supply a variety of different types of aggregate to batchers 54, 56 and 58, which is in turn supplied to conveyor 60 in batching module 12 and thence to either mobile mixer 18 or stationary mixer 20. Each of batchers 50 and 52 include a dispensing chute **50*b* and 52*b* respectively, at their lower ends, located adjacent the opposing ends of conveyor 60, such that the receiving hopper 18*a* and 20*a* of mobile mixer 18 and stationary mixer 20 receive materials from both conveyor 60 and the associated batcher 50 and 52**.

Figure 6:
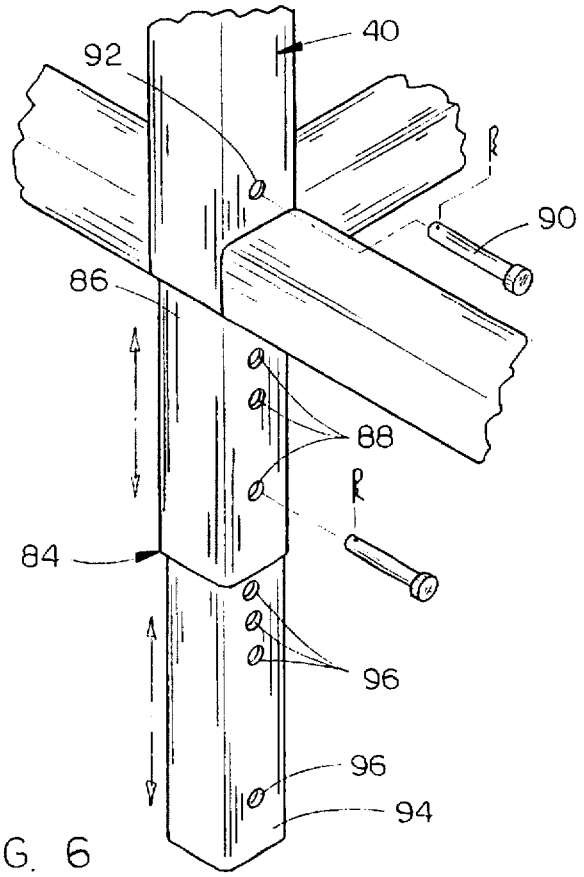
FIG. 6 is an enlarged perspective view of one adjustable leg of the batching module.

In order to support batching module 12 at an appropriate height at the ground to receive the mobile mixer 18 and the receiving hopper **20*a* of the large stationary drum mixer 20, a plurality of support legs 84 are provided. As shown in FIG. 6, each support leg 84 includes an elongated tubular upper leg 86 slidably journaled within one of the hollow posts 36, 38 or 40 (post 40 being shown in FIG. 6). Apertures 88 are formed vertically spaced apart along the length of leg 86 to receive a locking pin 90 journaled through an aperture 92 in post 40, to thereby selectively determine the length of upper leg 86 which projects from post 40. An elongated lower leg 94 is slidably journaled within upper leg 86 to permit telescoping extension thereof. Lower leg 94 also includes a series of vertically spaced apertures 96 for receiving a locking pin 98 journaled through one of upper leg apertures 88, to selectively adjust the length of lower leg 94 which projects from upper leg 86. As shown in FIG. 3, both the lower and upper legs may be telescoped entirely within the various posts 36, 38 and 40 to permit easy transport of batching module 12**.

Figure 7:
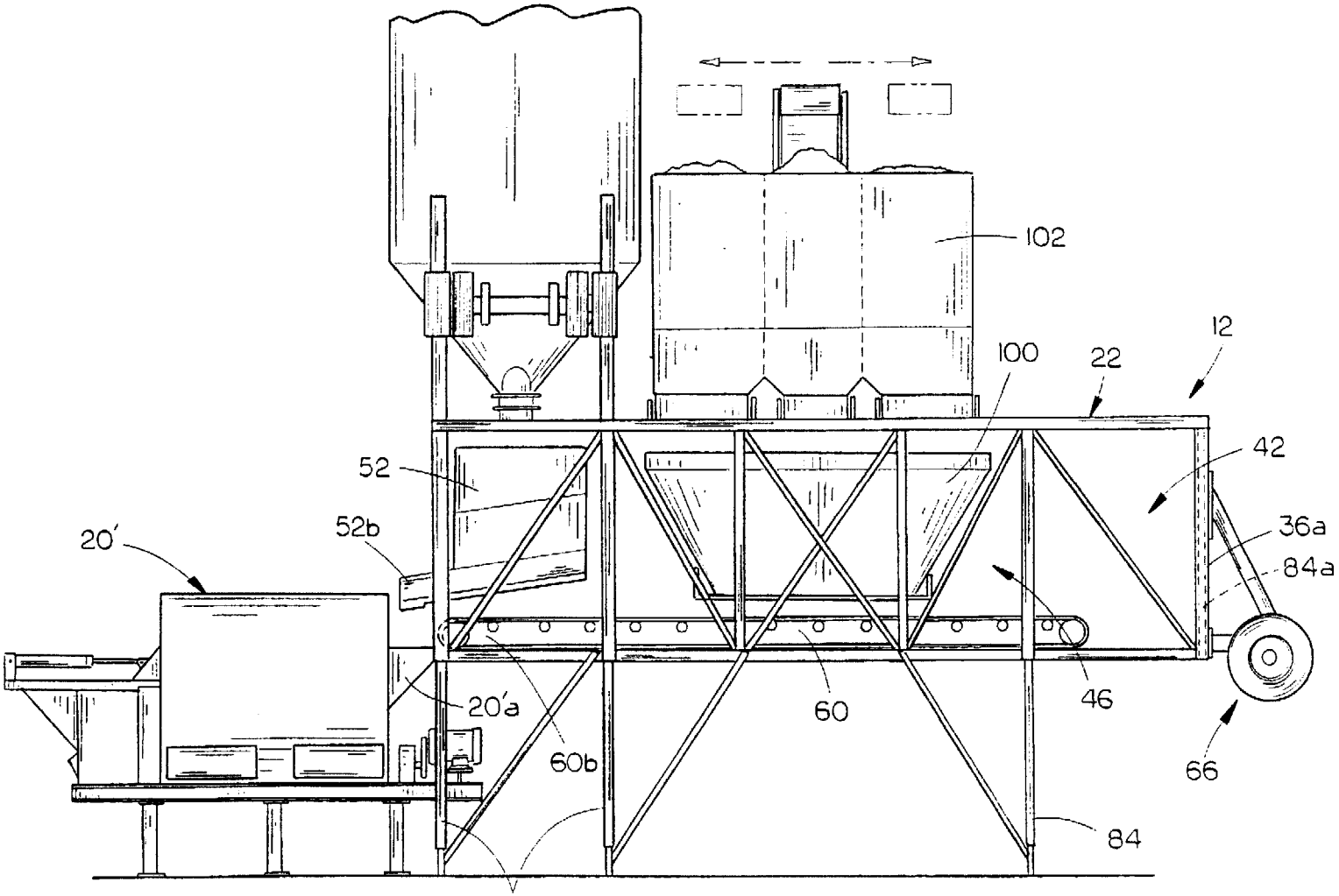
FIG. 7 is a side elevational view of the modular concrete batch plant, with alternative components utilized therein.

Referring now to FIG. 7, a small stationary drum mixer 20' is shown positioned with its inlet hopper **20'*a* disposed under the second end 60*b* of conveyor 60, and under the dispensing chute 52*b* of batcher 52. Because of the size of stationary drum mix 20', the legs 84 supporting batching module 12 are extended a length less than that shown in FIG. 1. Because of this reduced height, a mobile mixer (shown in FIG. 1) does not fit under the first cell 42 of batching module 12, making it unnecessary to extend leg 84*a* from post 36*a* of frame 22, and making removal of wheel set 66** unnecessary.

Because of the open framework of frame 22, the various batching apparatus may be selectively interchanged. In this case, a large aggregate batcher 100 is mounted within the third cell 46 of batching module 12. A large aggregate bin 102 is mounted on top of batching module frame 22 over third cell 46, to deposit aggregate within batcher 100, for subsequent dispensing on to conveyor 60.

Whereas the invention has been shown and described in connection with the preferred embodiment thereof, many modifications, substitutions and additions may be made which are within the intended broad scope of the appended claims.

I claim:

1. A batching module for a mobile batching plant, comprising:

an open three-dimensional frame having first and second longitudinal ends;

said frame having a plurality of cells defined within an interior thereof, each cell having means for securing one of a plurality of batching apparatus therein, each of said plurality of batching apparatus being interchangeable on said frame;

said frame cells including a first cell located at the frame first end, a second cell located at the frame second end, and a third cell intermediate the first and second cells;

a reversible conveyor mounted within the frame and extending from the first end to the second end, operable to convey material to the first and second ends of the frame;

a plurality of support legs mounted on the frame to support the frame at a predetermined height above the ground;

said legs being length extensible for selective height adjustment of the frame above the ground;

said frame including a plurality of vertically oriented hollow posts, with said legs telescopically mounted within the posts;

a first batcher removably mounted in the first cell of the frame, having a dispenser chute at a lower end thereof for dispensing contents therefrom; and a first mixer positioned under the first end of the frame;

said first mixer including a receiving hopper located beneath a first end of the conveyor for receiving material therefrom, and also located under the dispenser chute of the first batcher for receiving material therefrom.

2. The batching module of claim 1, further comprising:

a second batcher removably mounted in the second cell of the frame, having a dispenser chute at a lower end for dispensing contents thereof; and a second mixer positioned under the second end of the frame;

said second mixer including a receiving hopper located beneath a second end of the conveyor, for receiving material therefrom, and also located under the dispenser chute of the second batcher, for receiving material therefrom.

3. The batcher module of claim 2, further comprising a third batcher removably mounted in the third cell of the frame, having a dispenser chute at a lower end for dispensing contents thereof, said third batcher mounted with the dispenser chute located over the conveyor to dispense contents thereof.

4. The batch module of claim 3, further comprising a fourth batcher removably mounted in the third cell of the frame, adjacent to said third batcher, having a dispenser chute at a lower end located over the conveyor to dispense contents of the fourth batcher thereon.

5. The batch module of claim 4, wherein said first mixer is a mobile mixing vehicle.

6. The batch module of claim 5, wherein said second mixer is a stationary drum type mixer.

7. The batch module of claim 5, further comprising a plurality of panels removably connected to said frame, enclosing said frame against wind and weather.

8. The batch module of claim 7, further comprising:

a wheel set having means for detachably mounting the wheel set to the first end of the frame, for supporting the first end of the frame for transport; and a hitch having means for detachably mounting the hitch to the second end of the frame, for supporting the frame second end on a tractor, for transport.

9. A batching module for a mobile batching plant, comprising:

an open three-dimensional frame having first and second longitudinal ends;

said frame having a plurality of cells defined within an interior thereof, each cell having means for securing one of a plurality of batching apparatus therein;

said frame cells including a first cell located at the frame first end, a second cell located at the frame second end, and a third cell intermediate the first and second cells;

a plurality of support legs mounted on the frame to support the frame at a predetermined height above the ground;

a reversible conveyor mounted within the frame and extending from the first end to the second end, operable to convey material to the first and second ends of the frame;

a first batcher removably mounted in the first cell of the frame, having a dispenser chute at a lower end thereof for dispensing contents therefrom;

a first mixer positioned under the first end of the frame; and said first mixer including a receiving hopper located beneath a first end of the conveyor for receiving material therefrom, and also located under the dispenser chute of the first batcher for receiving material therefrom.

10. The batching module of claim 9, further comprising:

a second batcher removably mounted in the second cell of the frame, having a dispenser chute at a lower end for dispensing contents thereof; and a second mixer positioned under the second end of the frame;

said second mixer including a receiving hopper located beneath a second end of the conveyor, for receiving material therefrom, and also located under the dispenser chute of the second batcher, for receiving material therefrom.

11. The batch module of claim 10, wherein said first mixer is a mobile mixing vehicle.

12. The batcher module of claim 10, further comprising a third batcher removably mounted in the third cell of the frame, having a dispenser chute at a lower end for dispensing contents thereof, said third batcher mounted with the dispenser chute located over the conveyor to dispense contents thereof.

13. The batch module of claim 10, wherein said second mixer is a stationary drum type mixer.

14. The batch module of claim 9, further comprising a plurality of panels removably connected to said frame, enclosing said frame against wind and weather.

15. The batch module of claim 9, further comprising:

a wheel set having means for detachably mounting the wheel set to the first end of the frame, for supporting the first end of the frame for transport; and a hitch having means for detachably mounting the hitch to the second end of the frame, for supporting the frame second end on a tractor, for transport.

16. A batching module for a mobile batching plant, comprising:

an open three-dimensional frame having first and second longitudinal ends;

said frame having a plurality of cells defined within an interior thereof, each cell having means for securing one of a plurality of batching apparatus therein;

said frame cells including a first cell located at the frame first end, a second cell located at the frame second end, and a third cell intermediate the first and second cells;

a plurality of support legs mounted on the frame to support the frame at a predetermined height above the ground;

a reversible conveyor mounted within the frame and extending from the first end to the second end, operable to convey material to the first and second ends of the frame;

a first batcher removably associated with one of said cells of the frame, having a dispenser chute at a lower end thereof for dispensing contents therefrom above the conveyor;

a first mixer positioned under the first end of the frame; and said first mixer including a receiving hopper located beneath a first end of the conveyor for receiving material from the conveyor and batcher.

* * * * *